United States Patent [19]

Clifford

[11] 4,356,039

[45] * Oct. 26, 1982

[54] METHOD FOR CLEANING DRAINS AND WATERWAYS

[75] Inventor: Jack R. Clifford, Alton, Ill.

[73] Assignees: Paul L. Pratt; John T. Pierce, Jr.,; a part interest to each

[ * ] Notice: The portion of the term of this patent subsequent to Aug. 28, 1996, has been disclaimed.

[21] Appl. No.: 131,420

[22] Filed: Mar. 18, 1980

Related U.S. Application Data

[63] Continuation-in-part of Ser. No. 42,548, May 25, 1979, Pat. No. 4,218,803, and a continuation-in-part of Ser. No. 26,806, Apr. 3, 1979, Pat. No. 4,216,561.

[51] Int. Cl.[3] ..... B08B 9/02

[52] U.S. Cl. ..... 134/8; 15/104.3 R

[58] Field of Search ..... 15/104.3 R; 134/8, 24

[56] References Cited

U.S. PATENT DOCUMENTS

| | | | |
|---|---|---|---|
| 1,344,249 | 6/1920 | Stewart | 15/104.3 R |
| 1,498,446 | 6/1924 | Geskey | 15/104.3 R |
| 1,803,425 | 5/1931 | Cunningham | 134/24 X |
| 3,124,821 | 3/1964 | Mathews | 15/104.3 R X |
| 4,011,100 | 3/1977 | Ross | 134/8 |
| 4,216,561 | 8/1980 | Clifford | 15/104.3 R |
| 4,218,803 | 8/1980 | Clifford | 15/104.3 R |

*Primary Examiner*—Marc L. Caroff

*Attorney, Agent, or Firm*—Grace J. Fishel

[57] ABSTRACT

A method for cleaning storm sewers, sanitary sewers, culverts and other drains and waterways is disclosed which includes the steps of prewetting the debris in the waterway with water from a first water directing means, plowing the prewetted debris loose with a plowing means, further wetting the prewetted debris with water from a second water directing means, said first and second water directing means directing water simultaneously, and sweeping the further wetted debris forward with a plunging means.

6 Claims, 9 Drawing Figures

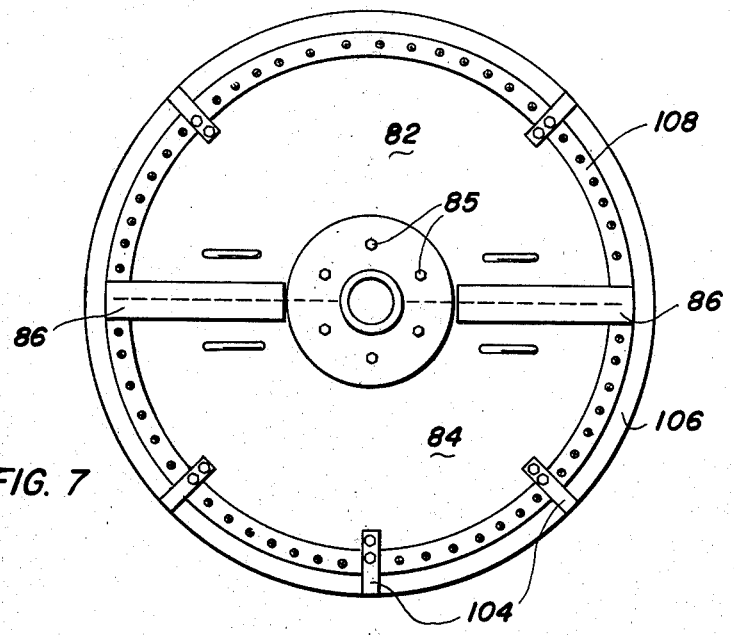
FIG. 7
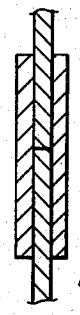
FIG. 9
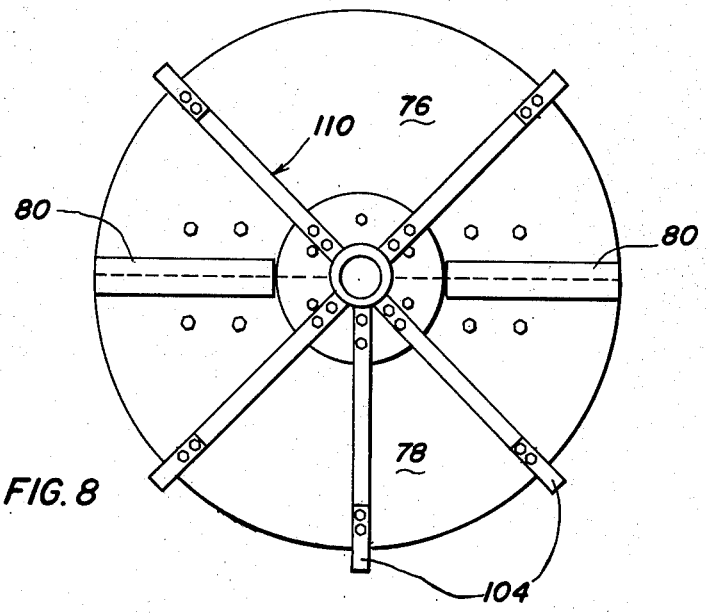
FIG. 8
FIG. 3
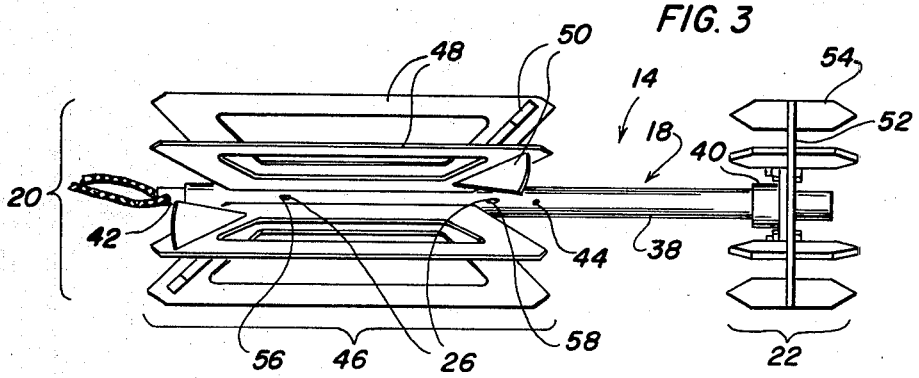

METHOD FOR CLEANING DRAINS AND WATERWAYS

This is a contination-in-part of application Ser. No. 26,806, filed Apr. 3, 1979, U.S. Pat. No. 4,216,561 and of application Ser. No. 42,548, filed May 25, 1979 U.S. Pat. No. 4,218,803, copies of which are attached hereto, said applications incorporated by reference herein.

The present invention, as described in the above-mentioned co-pending applications and as more particularly described hereinafter, relates to a method for cleaning storm sewers, sanitary sewers, culverts and other drain and waterways.

The equipment described in U.S. Pat. Nos. 4,216,561 and 4,218,803 is useful for cleaning out both sanitary and storm sewers. The greater challenge, however, is in cleaning out storm sewers since the debris found in them tends to be more compacted, including such materials as silt or clay intermixed with trash, rocks, tree limbs and so forth. The debris found in sanitary sewers tends to be less compacted and consists mainly of grease, sanitary wastes and the like with tree roots being the major hard obstruction.

In the past, culverts or the like have been cleaned by scraping the dirt out with a shovel. When the culvert was too small for a man to get inside, the balance of the culvert was cleaned out with a hose or with a hose carried on a carriage assembly which was dragged through the drain. Similar flushing devices have been used for cleaning out sanitary sewers.

Drain cleaners which depend on flushing the dirt out use vast amounts of water. In addition to being messy, the operation is also time consuming and inefficient. In the case of storm sewers, sanitary sewers, culverts and the like, the water must be trucked to the site. In the case of sanitary sewers, the water must also be pumped out of the system in most instances and trucked away to an approved disposal site.

Another problem with drain cleaners which depend on flushing the dirt out is that they are unable to clean really impacted drains. If a drain cannot be cleaned, it must be replaced. In the case of culverts, this means that the roadbed must be torn up and traffic rerouted while the old culvert is dug out, a new culvert installed and the road resurfaced.

In view of the above, there is a need for a method of cleaning out storm sewers, sanitary sewers, culverts and other drains and waterways which uses a minimal amount of water and which is effective for cleaning out even badly clogged drains. Therefore, among the several objects of the present invention may be noted the provision of a method for cleaning out drains which has the above-mentioned capabilities. Other objects and features will be in part apparent and in part pointed out hereinafter.

The invention accordingly comprises the methods hereinafter described, the scope of the invention being indicated in the subjoined claims. In the accompanying drawings, in which one of various possible embodiments of the invention is illustrated, corresponding reference numerals refer to corresponding parts and in which:

FIG. 1 is a longitudinal sectional view of a roadway wherein an implement as described in U.S. Pat. No. 4,218,803 is shown making a first pass through a large culvert;

FIG. 3 is a side elevational view of the implement shown in FIG. 1;

FIG. 7 is a rear view taken along line 7—7 in FIG. 6;

FIG. 8 is a rear view like FIG. 7 but with the rear plunger plates removed; and, FIG. 9 is a sectional view taken along line 9—9 in FIG. 5 showing details of the plunger plate assembly.

Figure 1:
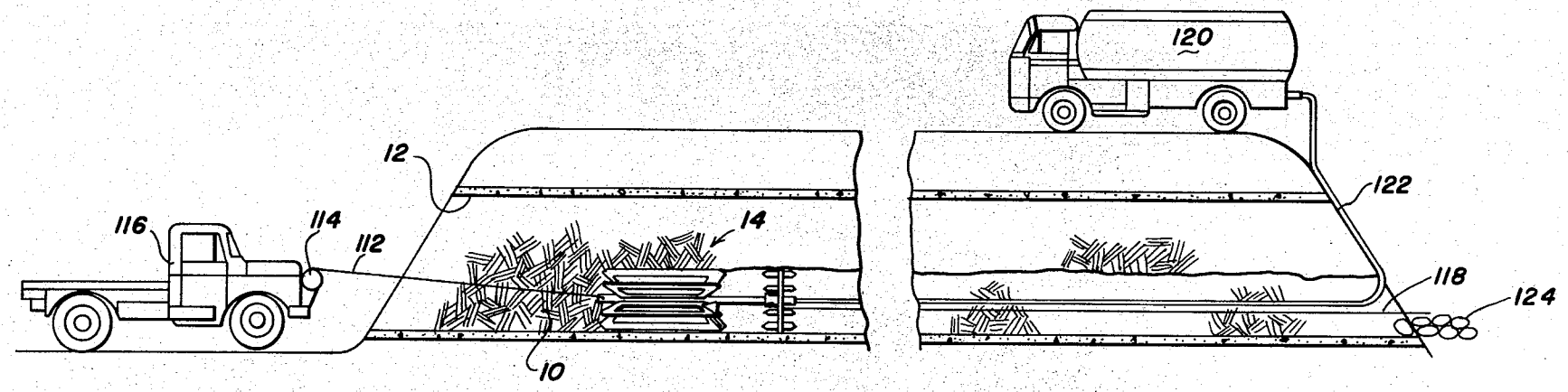
Figure 2:
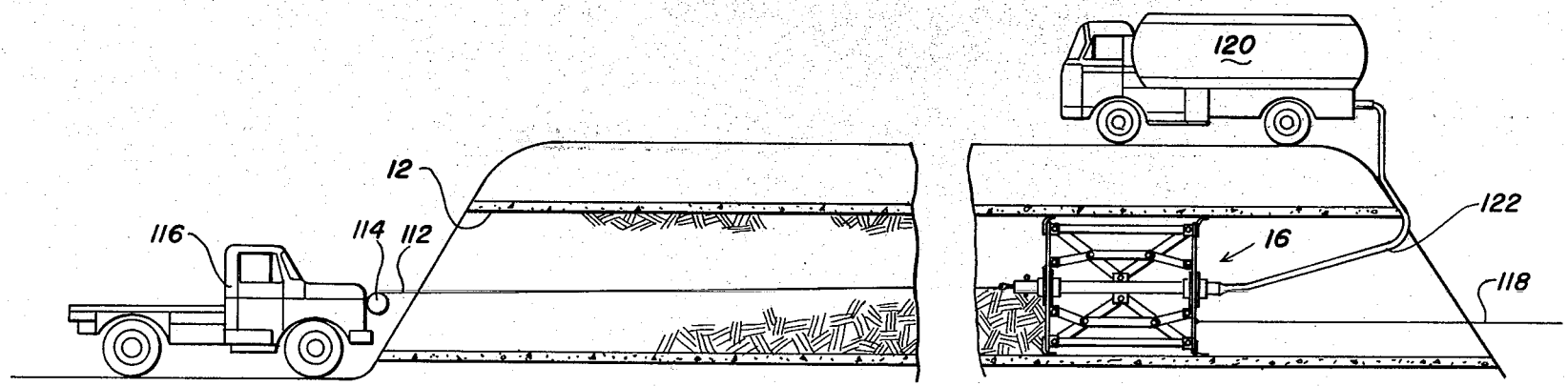
FIG. 2 is a longitudinal sectional view of the same roadway as in FIG. 1 showing a second implement as more particularly shown in FIGS. 4–9 making a second pass through the culvert.

Referring to the drawings more particularly by reference character, according to the present method debris 10 is cleaned out of an impacted culvert 12 by means of an implement 14, worked alone or in combination with an implement 16. As shown in FIGS. 1 and 2, implement 14 is used to cut a channel at or near the bottom of the culvert where the debris is most compacted. It also prewets the remaining debris which is then removed with implement 16.

While implements 14 and 16 have many elements in common as more particularly described below, implement 16 is built lighter than comparably sized implement 14. Since the weight of implements 14 and 16 increases as a squared function of the diameter, implements 14 and 16 are advantageously used in tandem in culverts having a diameter in excess of about 40 inches. It is to be understood, however, that this is not a hard and fast rule but is merely a rule of thumb based on field experience with culverts impacted with debris of moderately heavy clay composition.

As best seen in FIG. 3, implement 14 includes a carriage 18 with a plowing means 20 at its forward end and a plunging means 22 in spaced relationship therewith at its rearward end. It further includes a first water directing means (not visible) for prewetting the debris in advance of plowing means 20 and a second water directing means 26 for further wetting the prewetted debris before it is swept forward by plunging means 22. As illustrated, water is simultaneously sprayed by said first and second water directing means.

In the above-mentioned respects, implement 16 in the embodiment illustrated in FIGS. 4–7 similarly includes a carriage 28 with a plowing means 30 at its forward end and a stabilizer plunging means 32 at its rearward end. Like implement 14, it includes a first water directing means 34 for prewetting the debris in advance of plowing means 30 and a second water directing means 36 for further wetting the prewetted debris before it is swept forwards by plunging means 32.

Basically as shown in FIG. 3 and further described in U.S. Pat. No. 4,218,803, the carriage assembly 18 of implement 14 includes a hollow pipe 38 which is capped at its forward end and is threaded at its rearward end for attachment to a hose coupling. It further includes a pipe flange 40 for attaching plunging means 22 and a tow bar 42. Tow bar 42 extends through the end cap and is bolted at 44 within pipe 38 to effect transfer of the pulling force from the capped end of the pipe to carriage assembly 18 back of plowing means 20.

As shown, plowing means 20 is made up of six radially projecting cutter blade assemblies 46 which are equally spaced around the outside of pipe 38 and are mounted parallel to the longitudinal axis thereof. Other numbers of cutter blade assemblies 46 may be used, preferably varying in number from a minimum of three to a maximum of six. Each cutter blade assembly 46 includes a blade 48 and front and rear baffle plates 50, said baffle plates being welded on opposite sides of blades 48 at an angle from about 45 degrees to about 90 degrees depending on the type of material to be removed.

When implement 14 is dragged through culvert 12, the blade portions 48 of cutter blade assemblies 46 serve as runners. The baffle plates are fan shaped and sized such that the front baffle plate on one blade takes up one-half the area between adjacent blades while the rear baffle plate of the adjacent blade takes up the remaining half. So configured, baffle plates 50 sweep the entire area between blades 48 and torque implement 14 in a spiraling motion as it is towed. The front and rear baffle plates are set at opposite radial angles to maximize mixing of the material passing between the blades. As shown in U.S. Pat. No. 4,218,803, front baffle plates 50 tend to move the debris in a left hand helix towards the rear of the machine while the rear baffle plates tend to move it in a right hand helix towards the front.

Plunging means 22 include an annular plate 52 which has the same outside diameter as radially projecting cutter blade assemblies 46 and which is bolted to the above-mentioned pipe flange 40. As shown, six double pointed knives 54 are symmetrically arranged at the periphery but within the outer margin of plate 52.

In the form illustrated in U.S. Pat. No. 4,218,803, the first water directing means are formed in the end cap as four forwardly directed waterspouts for spraying water in advance of plowing means 20. Six additional waterspouts 56 make up the second water directing means 26 and are positioned behind and directed at an angle towards the front baffle plates while six others 58 are positioned behind rear baffle plates 50 but directed at an angle towards the plunging means 22.

When the diameter of culvert 12 is not much larger than the diameter of implement 14, it is unnecessary to use implement 16. When the culvert is more than about 40 inches in diameter, however as aforementioned, it is preferred to use a combination of implements 14 and 16 since the weight of an implement 14 large enough to clean the culvert in a single pass is prohibitive. For culverts having a diameter greater than about 40 inches, therefore, it is preferred to use a combination of implements 14 and 16, implement 14 to cut a channel along or near the floor of the impacted culvert and implement 16 to remove the balance of the debris.

As above mentioned, the principal elements of implement 16 are similar to those of implement 14. As shown in FIGS. 4–9, the carriage assembly 28 of implement 16, like implement 14, includes a hollow pipe 60 which is capped at its forward end 62 and is threaded at its rearward end 64 for attachment to a hose coupling. It includes a front cradle flange 66 for attaching plowing means 30, a rear cradle flange 68 for attaching stabilizing plunging means 32 and a tow bar 70. Tow bar 70 extends through end cap 62 and is bolted at 72 within pipe 60, like implement 14, to effect transfer of the pulling force from the capped end of the pipe to carriage assembly 28 back of plowing means 30. Cradle flanges 66 and 68 are mounted on pipe 60 with bolts 74.

Figure 5:
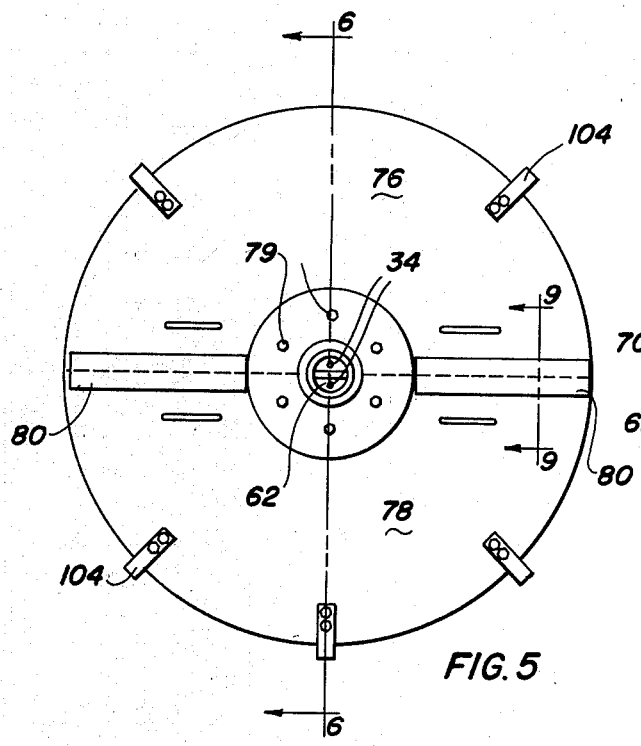
FIG. 5 is a front view.
Figure 6:
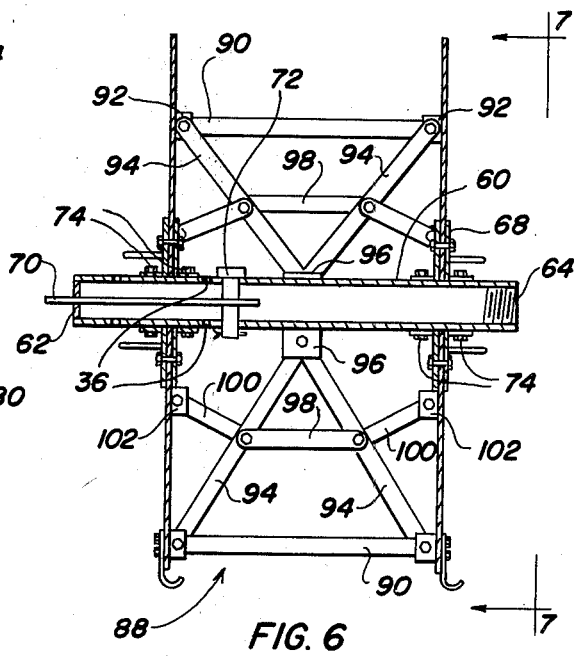
FIG. 6 is a sectional view taken along line 6—6 in FIG. 5.

Plowing means 30 is made up of upper and lower semicircular annular plates 76 and 78, respectively which are bolted at 79 within front cradle flange 66. As best seen in FIGS. 5 and 9, a pair of channel plates 80 are welded along the straight edge of lower plate 78, on opposite sides thereof, forming a slot into which upper plate 76 is fitted along its corresponding straight edge.

In the embodiment illustrated in FIGS. 4–7, plunging means 32 is identical to plowing means 30 and includes a pair of semicircular annular plates 82 and 84 which are bolted at 85 within rear cradle flange 68. Like plowing means 30, a pair of channel plates 86 are welded along the straight edge of lower plate 84 forming a slot into which upper plate 82 is fitted along its corresponding straight edge.

Five radially projecting truss assemblies 88 are proportionately spaced around the outside of pipe 60 to transfer the load on plowing and plunging means 30 and 32 back to pipe 60 which is better able to withstand the external force on the front of the implement. The main members of each truss assembly 88 include a base bar 90, opposite ends of which are pinned at ears 92 and join plowing and plunging means 30 and 32 adjacent their outer margins. A pair of torsion bars 94 make up the other main members of each assembly 88. Bars 94 are pinned at one end to ears 92 and at the opposite end to flanges 96 mounted on pipe 60. The minor members of each truss assembly 88 includes a brace bar 98 and a pair of links 100. Brace bars 98 join pairs of torsion bars 94 and are pinned to links 100 which, in turn, are pinned to ears 102 mounted on plowing and plunging means 30 and 32 radially inwardly of ears 92.

Five flexible spring plates 104 are spaced about the periphery of plowing and plunging means 30 and 32, preferably in line with truss assemblies 88, and serve as runners when implement 16 is towed. In the case of plunging means 32, a flexible gasket 106 is optionally fitted around the periphery and held in place by suitably grooved plates 108 for use as described hereinafter.

Figure 4:
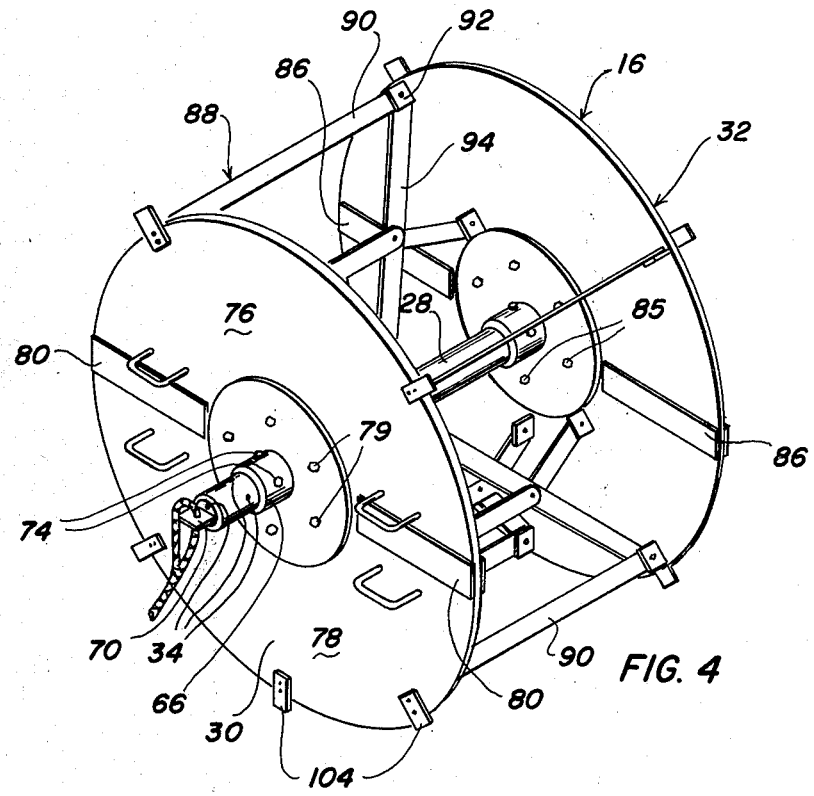
FIG. 4 is a perspective view of the implement shown in FIG. 2 having a front plow and a rear stabilizer plunger plate at its forward and rearward ends, respectively.

As shown in FIGS. 4 and 5, the first water directing means 34 are formed as four forwardly directed waterspouts for spraying water in advance of plowing means 30. Six additional waterspouts make up second water directing means 36 and are positioned behind plowing means 30 but in advance of plunging means 32.

In those cases when sufficient cleaning is achieved with plowing means 30 alone, plunging means 32 may be removed and replaced with a radial arm stabilizer assembly 110 as shown in FIG. 8. This construction is lighter and hence preferred wherever it can be used.

As illustrated in FIGS. 1–2, in the first step of the method of the present invention, debris 10 is cleared by hand in a sufficient amount to allow implement 14 to be placed in the high end of culvert 12. Implement 14 is then put in place with the front end of the machine facing the opposite end of the culvert. A cable 112 for towing implement 14 is attached to a rod (not shown) and is threaded through the top of culvert 12. Culverts are seldom allowed to silt up entirely and there is almost always some open space at the top of the culvert through which the cable can be passed and even if the culvert is completely plugged, the debris at the top tends to be soft or loose so that cable 112 can be easily punched through with the rod. Alternatively cable 112 can be carried through culvert 12 with a high pressure jet nozzle which is propelled by a backwards jet action. When the system to be cleaned is between manholes, it is impractical to thread the cable with a rod and a high pressure jet nozzle is preferred.

After cable 112 is threaded through the culvert, one end of it is hooked to tow bar 42 on implement 14, while the other end is attached to a means for pulling the implement through the culvert. As shown in the drawings, a winch 114 is provided as a power take-off from a truck 116. It is preferred that the pull on cable 112 be in line with the long axis of culvert 12. In many cases, however, because of the lay of the land or the softness of the soil, it is inconvenient to locate the winch in line with the low end of the culvert. In these case, it is preferred to run cable 112 through a pulley or snatch block (not shown) anchored to a backhoe (not shown) or the like which is in line with the culvert. Truck 116 with winch 114 can then be located on the roadway above the culvert or the like.

A second cable 118 is attached to plunging means 22 at the rear of implement 14 for dragging the machine out backwards with a winch 114 (not shown) on a truck 116 (not shown) like that for pulling cable 112. A source of water under high pressure such as water truck 120 is attached by means of a flexible hose 122 to implement 14 at the aforementioned hose coupling.

Sand bags 124 or other suitable dike means such as water tight plugs are placed around the rear of implement 14 and the water from water truck 120 is turned on. After an amount of water has accumulated in the end of culvert 12, typically about 100 gallons, the implement is towed forward by winch 114. The accumulated water which is confined in the culvert by sand bags 124 liquefies the debris around the implement and lubricates its passage. While water is sprayed out of first water directing means 24, plowing means 20 scrape a channel in culvert 12 and, in the embodiment shown in FIGS. 1 and 3 and which is further described in U.S. Pat. No. 4,218,803, plowing means 20 deflect dislodged materials towards second water directing means 26 where it is further wetted with water.

Dislodged and slightly wetted materials are deflected backwardly and radially inwardly by front baffle plates 50. As the material passes around the front baffle plates, it is sprayed by waterspouts 56 with more water. It is then directed towards the rear baffle plates where it is deflected forwardly and radially inwardly to maximize mixing of the materials with water. When the material passes around rear baffle plates 50, it is still further wetted with water by waterspouts 58. The liquefied debris is then swept forward by annular plate 52 which functions as a plunger.

In some instances, the debris in culvert 12 may be so compacted, that it is necessary to remove annular plate 52 from implement 14 during its first pass through the culvert. After the first pass, plate 52 is then reinstalled and the implement operated as above described. While the implement shown in FIGS. 1 and 3 is not radially adjustable, means for accomplishing this are described in U.S. Pat. No. 4,218,803 and may be used herein. After implement 14 has been passed through culvert 12 with plate 52 in place, it can be dragged back through the culvert on cable 118 and removed.

Implement 16 is then placed in the high end of culvert 12 with the front end facing the opposite end. Preferably implement 16 is trucked to the work site in disassembled condition and assembled there. Besides being unwieldy in assembled condition, it is preferred to assemble implement 16 at the job since some of its parts, e.g. carriage assembly 28 and so forth are universal for all diameters. It makes no sense to provide different carriage assemblies for each diameter of machine. Other parts such as upper and lower annular plates 76, 78, 82 and 84, torsion bars 94 and the minor members of the truss assemblies are specially sized for each diameter. In practice, all of the unique members are labled for size, e.g. T-72 indicates that torsion bar 94 is adapted for a 72-inch culvert. The brace bars, links, annular plates and so forth can be similarly marked.

In assembly, tow bar 70 is inserted in pipe 60 and cradle flanges 66 and 68 are attached. For ease of handling during assembly, lift rings 126 are provided on each of annular plates 76, 78, 82 and 84. The lower annular plates are lifted by rings 126 and bolted into cradle flanges 66 and 68 and then the upper annular plates are lifted by rings 126 and seated in the slot between channel plates 86 and in cradle flanges 66 and 68. The truss assemblies are then bolted to plates 76, 78, 82 and 84 which form the plowing and plunging means as aforementioned.

In some instances, the upper plate 82 on plunging means 32 may be omitted. Similarly, in some instances, both plates 82 and 84 may be omitted and radial arm assembly 110 installed instead. What is preferred depends on actual field conditions and the amount of remaining debris to be removed.

Cable 112 is attached to tow bar 70 and second cable 118 is attached to plunging means 32 at the rear of implement 16. Water truck 120 is attached by hose 122 to threaded end 64. The hose is pressured up and implement 16 is towed through culvert 12 on cable 112 while water is simultaneously sprayed out of first and second water directing means 34 and 36. Plowing means 30 scrape the walls of culvert 12 and push the liquefied debris along in front of the machine. Any debris getting past plowing means 30 is further wetted with water from second water directing means 36 and is pushed forward by plunging means 32. If gasket 106 is present, very little, if any, debris is left behind.

While the above discussion has dealt primarily with culverts, basically the same technique can be applied to any drain or waterway. In the case of sanitary sewers, however, it is also necessary to have a vacuum water or sludge pump truck (not shown) to extract the liquefied debris out of a downstream manhole. Snatch blocks or pulleys are anchored in the bottom and top of each pair of manholes which allows cable 112 to pull implements 14 or 16 to the low end of the drain. The same techniques apply to box culverts or the like wherein implements of the kind described in U.S. Pat. No. 4,216,561 may be utilized.

In view of the above, it will be seen that the several objects of the invention are achieved and other advantageous results attained. As various changes could be made in the described methods without departing from the scope of the present invention it is intended that all matter contained in the above description or shown in the accompanying drawings shall be interpreted as illustrative and not in a limiting sense.

What is claimed is:

1. A method for cleaning storm sewers, sanitary sewers and other drains and waterways which comprises the steps of prewetting the debris in the waterway with water from a first water directing means, plowing the prewetted debris loose with a plowing means, further wetting the prewetted debris with water from a second water directing means, said first and second water directing means directing water simultaneously, and sweeping the debris forward with a plunging means, wherein said steps are accomplished by towing an implement comprising an elongated carriage assembly with plowing means at its forward end and plunging means at its rearward end in spaced relationship with said plowing means, said first water directing means spraying water in advance of said plowing means and said second water directing means spraying water behind the plowing means but in advance of the plunging means.

2. The method of claim 1 wherein the prewetted debris plowed loose by the plowing means is directed by the plowing means radially inwardly and backwardly towards the plowing means.

3. The method of claim 2 wherein the further wetted debris is allowed to liquefy before it is swept forward by the plunging means.

4. The method of claim 3 wherein said steps are repeated, at least once to cut a channel through the debris in said drain or waterway and at least once to remove substantially the balance of the debris.

5. The method of claim 1 wherein said drain or waterway has a tubular configuration and wherein said steps are accomplished by towing an implement comprising an elongated carriage assembly with means for cutting at its forward end and plunging means at its rearward end in spaced relationship with said cutting means, said cutting means comprising a plurality of blades radially extending from the carriage assembly, said plunging means comprising a plate having substantially the same diameter as said radially extending blades, said implement further including a first water directing means for spraying water in advance of said cutting means and a second water directing means for spraying water behind said cutting means but in advance of said plunging means through the drain or waterway.

6. The method of claim 1 for cleaning box culverts and other drains and waterways having a rectangular cross section wherein said steps are accomplished by towing an implement comprising a body with means for plowing at its forward end and plunging means at its rearward end, said means for plowing directing material plowed loose by said plowing means upwardly and backwardly as well as laterally outwardly towards said plunging means, said implement further including a first water directing means for spraying water in advance of said plowing means and a second water directing means for spraying water behind said plowing means but in advance of said plunging means through the drain or waterway.

* * * * *